US012384983B2

(12) United States Patent
Hawkins et al.

(10) Patent No.: US 12,384,983 B2
(45) Date of Patent: Aug. 12, 2025

(54) HIGH PERFORMANCE GEAR OIL AND RELATED METHODS

(71) Applicant: ExxonMobil Technology and Engineering Company, Spring, TX (US)

(72) Inventors: Harrison T. Hawkins, Medford, NJ (US); Michael Blumenfeld, Annandale, NJ (US); Nilka Y. Brown, Conroe, TX (US); Rugved P. Pathare, Pittstown, NJ (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 18/651,789

(22) Filed: May 1, 2024

(65) Prior Publication Data

US 2024/0368495 A1 Nov. 7, 2024

Related U.S. Application Data

(60) Provisional application No. 63/499,425, filed on May 1, 2023.

(51) Int. Cl.

| | |
|---|---|
| ***C10M 169/04*** | (2006.01) |
| ***C10M 101/02*** | (2006.01) |
| ***C10M 107/02*** | (2006.01) |
| ***C10M 111/04*** | (2006.01) |
| ***C10M 127/06*** | (2006.01) |
| ***C10M 129/72*** | (2006.01) |
| ***C10M 129/74*** | (2006.01) |
| ***C10M 141/02*** | (2006.01) |
| *C10N 20/02* | (2006.01) |
| *C10N 30/02* | (2006.01) |
| *C10N 30/04* | (2006.01) |
| *C10N 30/10* | (2006.01) |
| *C10N 30/12* | (2006.01) |
| *C10N 30/18* | (2006.01) |
| *C10N 40/04* | (2006.01) |

(52) U.S. Cl.

CPC ..... *C10M 169/04* (2013.01); *C10M 101/02* (2013.01); *C10M 107/02* (2013.01); *C10M 111/04* (2013.01); *C10M 127/06* (2013.01); *C10M 129/72* (2013.01); *C10M 129/74* (2013.01); *C10M 141/02* (2013.01); *C10M 2203/06* (2013.01); *C10M 2203/1085* (2013.01); *C10M 2205/0206* (2013.01); *C10M 2207/282* (2013.01); *C10M 2207/283* (2013.01); *C10N 2020/02* (2013.01); *C10N 2030/02* (2013.01); *C10N 2030/041* (2020.05); *C10N 2030/10* (2013.01); *C10N 2030/12* (2013.01); *C10N 2030/18* (2013.01); *C10N 2040/04* (2013.01)

(58) Field of Classification Search

CPC ..... C10M 169/04; C10M 101/02; C10M 107/02; C10M 111/04; C10M 127/06; C10M 129/72; C10M 129/74; C10M 141/02; C10M 2203/06; C10M 2203/1085; C10M 2205/0206; C10M 2207/282; C10M 2207/283; C10M 2203/1025; C10M 2205/0285; C10M 2205/173; C10M 2205/223; C10M 2207/2825; C10M 2207/2835; C10M 2209/1033; C10M 2209/1085; C10M 2223/0405; C10M 171/02; C10N 2020/02; C10N 2030/02; C10N 2030/041; C10N 2030/10; C10N 2030/12; C10N 2030/18; C10N 2040/04; C10N 2020/011

See application file for complete search history.

(56) References Cited

U.S. PATENT DOCUMENTS

| | | | | |
|---|---|---|---|---|
| 2007/0000807 | A1* | 1/2007 | Wu | C10M 169/04 208/18 |
| 2009/0088356 | A1* | 4/2009 | Hee | C10M 111/04 508/591 |
| 2010/0087349 | A1* | 4/2010 | Lee | C10M 111/04 508/499 |
| 2010/0323937 | A1* | 12/2010 | Wu | C10M 107/06 508/591 |
| 2011/0136714 | A1* | 6/2011 | Haigh | C10M 171/02 508/591 |

(Continued)

OTHER PUBLICATIONS

ISR-WO dated Aug. 19, 2024 for related matter PCT/US2024/027149.

*Primary Examiner* — Ellen M McAvoy

(74) *Attorney, Agent, or Firm* — Vorys, Sater, Seymour and Pease LLP

(57) ABSTRACT

Gear oil compositions including a first oil basestock and a second basestock. The first basestock includes a Group II bright stock having a kinematic viscosity (ASTM D445, 40° C.) of from 250 $mm^2/s$ to 600 $mm^2/s$, a kinematic viscosity (ASTM D445, 100° C.) of from 20 $mm^2/s$ to 70 $mm^2/s$, a viscosity index (ASTM D2270) of from 80 to 120, and a pour point (ASTM D97) of from −50° C. to −20° C. The second basestock includes a polyalphaolefin (PAO) basestock having a kinematic viscosity (ASTM D445, 40° C.) of from 500 $mm^2/s$ to 3500 $mm^2/s$, a kinematic viscosity (ASTM D445, 100° C.) of from 60 $mm^2/s$ to 300 $mm^2/s$, a viscosity index (ASTM D2270) of from 150 to 250, and a pour point (ASTM D97) of from −50° C. to −20° C.

20 Claims, No Drawings

(56) References Cited

U.S. PATENT DOCUMENTS

| | | | | |
|---|---|---|---|---|
| 2016/0053192 | A1* | 2/2016 | Miller | C10M 169/041 585/13 |
| 2016/0237368 | A1* | 8/2016 | Hobday | F16H 57/0498 |
| 2017/0183580 | A1* | 6/2017 | Harandi | C10G 67/0445 |
| 2017/0211005 | A1 | 7/2017 | Yeh | |
| 2021/0130731 | A1* | 5/2021 | Ono | C10M 137/04 |

* cited by examiner

HIGH PERFORMANCE GEAR OIL AND RELATED METHODS

FIELD OF INVENTION

This application relates to compositions suitable as lubricants and, more particularly for use as gear oils, and methods concerning the same.

BACKGROUND

Oil basestock is the major constituent in finished lubricants and contributes significantly to the properties of the lubricant. Gear oils are finished lubricants intended for use in the automotive, industrial, or marine industries, such as for use in gearboxes, transmissions, differentials, transaxles, and transfer cases. Gear oils help drivetrains run smoothly and protect critical internal parts of a vehicle's various gear systems from heat and wear damage. Inadequate lubrication can result in pitting (e.g., micropitting), corrosion, scouring, scuffing, and other damage to drive train components.

Gear oil generally has a higher viscosity compared to other similar lubricants, such as engine oil. The high viscosity of gear oil permits it to cope with rotational movement, sliding movement, or other frictional movement between machine or equipment parts.

Gear oils contain two general components, namely, one or more oil basestocks and additives. Blends of these components can be used to achieve particular desired characteristics of a gear oil.

According to the American Petroleum Institute (API) classifications, oil basestocks are categorized in five groups based on their saturated hydrocarbon content, sulfur level, and viscosity index. Lubricants oil basestock are typically produced in large scale from non-renewable petroleum sources. Group I, II, and III oil basestocks are all derived from crude oil via extensive processing, such as solvent extraction, solvent or catalytic dewaxing, and hydroisomerization. Group III oil basestocks can also be produced from synthetic hydrocarbon liquids obtained from natural gas, coal, or other fossil resources; Group IV base stocks are polyalphaolefins (PAOs), and are produced by oligomerization of alpha olefins, such as propene, 1-butene, or 1-decene. Group V base stocks include all base stocks that do not belong to Groups I-IV, such as naphthenics, polyalkylene glycols (PAG), and esters.

Historically, gear oil formulations have been limited to the use of an API Group I oil basestocks, particular Group I bright stock, polyisobutylene, conventional polyalphaolefin (PAO), and metallocene PAO to attain viscosities high enough for gear oil applications. High performance gear oil is designed for extreme friction protection, as well as protection from extreme temperatures, shock loads, scuffing, scouring, and pitting, such as experienced in high speed, high load, high torque, and high horsepower conditions. Generally oil basestocks for the formulation of high performance gear oil are limited to conventional PAO, metallocene PAO, API Group V oil basestocks, or a mixture of the three.

Traditional gear oil, particularly high performance gear oil, can be quite costly given their heavy reliance on synthetic oil. Accordingly, there is a need for a reduced-cost gear oil, particularly one that can be used for high performance applications that can achieve the required industry standards and regulations.

SUMMARY OF INVENTION

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

A first nonlimiting gear oil composition of the present disclosure includes: a gear oil composition comprising: a first oil basestock, the first oil basestock being a Group II bright stock having: a kinematic viscosity (ASTM D445, 40° C.) of from 250 $mm^2/s$ to 600 $mm^2/s$, a kinematic viscosity (ASTM D445, 100° C.) of from 20 $mm^2/s$ to 70 $mm^2/s$, a viscosity index (ASTM D2270) of from 80 to 120, and a pour point (ASTM D97) of from −50° C. to −20° C.; and a second oil basestock, the second oil basestock being a polyalphaolefin (PAO) basestock having: a kinematic viscosity (ASTM D445, 40° C.) of from 500 $mm^2/s$ to 3500 $mm^2/s$, a kinematic viscosity (ASTM D445, 100° C.) of from 60 $mm^2/s$ to 300 $mm^2/s$, a viscosity index (ASTM D2270) of from 150 to 250, and a pour point (ASTM D97) of from −50° C. to −20° C.

A second nonlimiting gear oil method of the present disclosure includes: mixing a first oil basestock and a second basestock, wherein the first basestock is a Group II bright stock having: a kinematic viscosity (ASTM D445, 40° C.) of from 250 $mm^2/s$ to 600 $mm^2/s$, a kinematic viscosity (ASTM D445, 100° C.) of from 20 $mm^2/s$ to 70 $mm^2/s$, a viscosity index (ASTM D2270) of from 80 to 120, and a pour point (ASTM D97) of from −50° C. to −20° C.; and wherein the second basestock is a polyalphaolefin (PAO) basestock having: a kinematic viscosity (ASTM D445, 40° C.) of from 500 $mm^2/s$ to 3500 $mm^2/s$, a kinematic viscosity (ASTM D445, 100° C.) of from 60 $mm^2/s$ to 300 $mm^2/s$, a viscosity index (ASTM D2270) of from 150 to 250, and a pour point (ASTM D97) of from −50° C. to −20° C.

These and other features and attributes of the disclosed compositions and methods of the present disclosure and their advantageous applications and/or uses will be apparent from the detailed description which follows.

DETAILED DESCRIPTION

This application relates to compositions suitable as lubricants and, more particularly for use as gear oils, and methods concerning the same.

The present disclosure provides gear oil compositions comprising at least a Group II bright stock (BS), a PAO basestock, optionally a Group II-IV low viscosity (LS) trim oil basestock, and optionally a Group V co-basestock. The gear oil compositions described herein advantageously perform to the same level of more costly neat conventional PAO formulations and other synthetic gear oils, and can be used in automotive, industrial, and marine applications. Accordingly, the described gear oils provide significant advantages in areas of without compromising performance.

The gear oils of the present disclosure may further improve elastohydrodynamic lubrication (EHL) film thickness (resulting in a thicker EHL film), thus critically improving gear life and pitting (e.g., micropitting) performance compared to convention gear oil formulations (e.g., conventional PAO-based gear oils). Unexpectedly, the gear oil of the present disclosure further achieves the required industry standards and regulations, the benefits listed hereinabove, without sacrificing oxidative performance or cleanliness. Further, and unexpectedly, the described gear oil shows equivalent viscosity index (VI) and low temperature properties compared to conventional PAO gear oils not previously attainable by vase oils other than Group IV and Group V.

As described above, the gear oil compositions of the present disclosure may be used in automotive, industrial, and marine applications. In certain embodiments, the gear oil is specifically formulated for lubricating gearboxes, transmissions, differentials, transaxles, and transfer cases. For example, in one aspect, the gear oil is formulated for lubricating a gearbox (e.g., main gearbox) of a wind turbine.

Definitions

The term "wt %" as used herein indicates percentage by weight, "vol %" as used herein indicates percentage by volume, "mol %" as used herein indicates percentage by mole, "ppm" as used herein indicates parts per million, and "ppm wt" and "wppm" are used interchangeably and mean parts per million on a weight basis. All concentrations herein, unless otherwise stated, are expressed on the basis of the total amount of the composition in question.

The terms "oil base stock," "oil basestock," "base oil," or "basestock," or "bright stock," and grammatical variations thereof, as used herein, refer to any base fluid that could be used in a lubricant including, but not limited to, a terpene, a mineral oil, a synthetic hydrocarbon, an ester, the like, or any combination thereof. An oil base stock as described herein may describe Group I, II, III, IV, and V (as defined by American Petroleum Institute (API)) base oils, including any combination thereof.

Base Stock Blend

The present disclosure includes methods and compositions related to a gear oil comprising at least API Group II bright stock and a PAO. Optionally, the gear oil may comprise a Group II-IV trim oil basestock. Further, optionally, the gear oil may comprise a Group V co-basestock.

The Group II bright stock is formed from a Group II basestock, such as through catalytic processing of deasphalted Group II basestock, or through hydrotreatment (sour conditions) followed by catalytic dewaxing (sweet conditions) of a deasphalted Group II oil. Gear oil formulations of the present disclosure, due to the use of extra-heavy Group II bright stocks, may allow for increased performance similar to or exceeding performance standards of gear oils formulated with solely Group IV basestocks (e.g., PAOs) while having lower cost and not requiring a higher wt % of thickener. An example of a suitable commercially available Group II bright stock includes, but is not limited to, EHC 340 MAX™ (ExxonMobil, Texas).

Suitable Group II bright stocks may have a kinematic viscosity (ASTM D445-21, 40° C.) of from 250 $mm^2/s$ to 600 $mm^2/s$ (or 250 $mm^2/s$ to 300 $mm^2/s$, or 320 $mm^2/s$ to 520 $mm^2/s$, or 380 $mm^2/s$ to 520 $mm^2/s$, or 450 $mm^2/s$ to 520 $mm^2/s$, or 288 $mm^2/s$ to 352 $mm^2/s$), encompassing any value and subset therebetween; and a kinematic viscosity (ASTM D445-21, 100° C.) of from 20 $mm^2/s$ 70 $mm^2/s$ (or 20 $mm^2/s$ to 36 $mm^2/s$, or 27 $mm^2/s$ to 36 $mm^2/s$, or 36 $mm^2/s$ to 42 $mm^2/s$, or 45 $mm^2/s$ to 50 $mm^2/s$, or 60 $mm^2/s$ to 70 $mm^2/s$), encompassing any value and subset therebetween. Suitable Group II bright stock may have a viscosity index (ASTM D2270-16) of from 80 to 120 (or 95 to 115, or 100 to 110, or 105 to 110), encompassing any value and subset therebetween. Suitable Group II bright stock may have a pour point (IP 15 or ASTM D97) of from −50° C. to −20° C. (or −45° C. to −30° C., or −45° C. to −39° C.), encompassing any value and subset therebetween.

The gear oil of the present disclosure further comprises a PAO or ETL (ethylene to liquid), which is not considered to be particularly limited. The PAO may include, for example, conventional PAO (light or heavy), metallocene PAO (mPAO), and any combination thereof. In some embodiments, the PAO is a mPAO or combination of mPAOs; examples of suitable mPAOs include, but are not limited to, mPAO 300, mPAO 150, mPAO 65, and any combination thereof.

In one or more instances, the PAO for use in the gear oil of the present disclosure may have a kinematic viscosity (ASTM D445, 40° C.) of from 500 $mm^2/s$ to 3500 $mm^2/s$ (or 500 $mm^2/s$ to 1000 $mm^2/s$, or 1000 $mm^2/s$ to 1500 $mm^2/s$, or 1500 $mm^2/s$ to 2000 $mm^2/s$, or 2000 $mm^2/s$ to 2500 $mm^2/s$, or 2500 $mm^2/s$ to 3000 $mm^2/s$, or 3000 $mm^2/s$ to 3500 $mm^2/s$, or 1000 $mm^2/s$ to 2500 $mm^2/s$), encompassing any value and subset therebetween; and a kinematic viscosity (ASTM D445-21, 100° C.) of from 60 $mm^2/s$ to 300 $mm^2/s$ (or 60 $mm^2/s$ to 100 $mm^2/s$, or 100 $mm^2/s$ to 150 $mm^2/s$, or 150 $mm^2/s$ to 200 $mm^2/s$, or 200 $mm^2/s$ to 250 $mm^2/s$, or 250 $mm^2/s$ to 300 $mm^2/s$, or 100 $mm^2/s$ to 250 $mm^2/s$), encompassing any value and subset therebetween. PAO may have a viscosity index (ASTM D2270-16) of from 150 to 250 (or 150 to 165, or 170 to 200, or 175 to 180, or 200 to 250, or 170 to 250), encompassing any value and subset therebetween. The PAO may have a pour point (IP 15 or ASTM D97) of from −50° C. to −20° C. (or −45° C. to −30° C., or −45° C. to −39° C.), encompassing any value and subset therebetween.

In some embodiments, the Group II bright stock may be present in the gear oil in an amount of from 15 wt. % to 50 wt. % of the gear oil formulation (or 15 wt. % to 30 wt. %, or 25 wt. % to 35 wt. %, or 30 wt. % to 35 wt. %, or 40 wt. % to 45 wt. %, or 45 wt. % to 50 wt. %), encompassing any value and subset therebetween, by total weight of the gear oil formulation.

In certain preferred embodiments, the PAO may be a metallocene PAO. Regardless of the type of PAO, the PAO may be present in the gear oil in an amount of from 10 wt. % to 70 wt. % of the gear oil formulation (or 25 wt. % to 50 wt. %, or 45 wt. % to 50 wt. %, or 50 wt. % to 60 wt. %, or 55 wt. % to 65 wt. %, or 60 wt. % to 70 wt. %), encompassing any value and subset therebetween, by total weight of the gear oil formulation.

As described above, the gear oil may optionally additionally include a Group II-IV trim oil basestock. The "trim oil basestock," and grammatical variants thereof, refers to a low viscosity (LS) oil basestock used to make any necessary adjustments to the gear oil blend to ensure that the gear oil meets the requirements for a gear oil lubricant, based on desired formulation requirements, as well as industry standards and regulations. Examples of suitable LS trim oil basestocks may include any LS Group II-IV oil basestocks including, but not limited to, a PAO (e.g., PAO 6, PAO 4), a gas-to-liquids (GTL) basestock (e.g., GTL 4, GTL 8), and the like, and any combination thereof. An example of a suitable commercially available trim oil basestocks for use in the present disclosure includes, but is not limited to, EHC™ basestocks (ExxonMobil, Texas), such as EHC™ 50. When included, the optional LS trim oil basestock may be in an amount of from 3 wt. % to 35 wt. % (or 3 wt. % to 5 wt. %, or 5 wt. % to 7.5 wt. %, or 7.5 wt. % to 10 wt. %, or 10 wt. % to 12 wt. %, or 12 wt. % to 18 wt. %, or 18 wt. % to 20 wt. %, or 20 wt. % to 25 wt. %, or 25 wt. % to 32 wt. %, or 32 wt. % to 35 wt. %), encompassing any value and subset therebetween, by total weight of the gear oil formulation.

As described above, the gear oil may optionally additionally include a Group V basestock, including naphthenics, polyalkylene glycols (PAG), esters (e.g., phosphate ester, polyester), and the like. Suitable Group V basestocks may have a kinematic viscosity (ASTM D445, 40° C.) of from 15 $mm^2/s$ to 600 $mm^2/s$ (or 15 $mm^2/s$ to 100 $mm^2/s$, or 200 $mm^2/s$ to 300 $mm^2/s$, 320 $mm^2/s$ to 520 $mm^2/s$, or 380 $mm^2/s$ to 520 $mm^2/s$, or 450 $mm^2/s$ to 520 $mm^2/s$), encompassing any value and subset therebetween; and a kinematic viscosity (ASTM D445-21, 100° C.) of from 4 $mm^2/s$ to 60 $mm^2/s$ (or 4 $mm^2/s$ to 15 $mm^2/s$, or 20 $mm^2/s$ to 36 $mm^2/s$, or 27 $mm^2/s$ to 36 $mm^2/s$, or 36 $mm^2/s$ to 42 $mm^2/s$, or 45 $mm^2/s$ to 50 $mm^2/s$), encompassing any value and subset therebetween. Suitable Group V basestock may have a viscosity index (ASTM D2270-16) of from 80 to 200 (or 95 to 115, or 100 to 120, or 120 to 140, or 140 to 160, or 160 to 180, or 180 to 200, or 100 to 200, or 150 to 200, or 80 to 150), encompassing any value and subset therebetween. Suitable Group II bright stock may have a pour point (IP 15 or ASTM D97) of from −60° C. to −20° C. (or −60° C. to −50° C., or −45° C. to −30° C., or −45° C. to −39° C.), encompassing any value and subset therebetween.

In total, the Group II bright stock, PAO, and optional Group V basestock may be present in the gear oil formulations of the present disclosure from 60 wt % to 99.5 wt % (or 70 wt % to 99.5 wt %, or 80 wt % to 99.5 wt %, or 60 wt % to 95 wt %, or 70 wt % to 95 wt %, or 80 wt % to 95 wt %, or 80 wt % to 94 wt %, or 80 wt % to 93 wt %, or 85 wt % to 95 wt %, or 85 wt % to 94 wt %, or 85 wt % to 93 wt %), encompassing any value and subset therebetween, by total weight of the gear oil formulation.

Solubilizing Agent

The solubilizing agent additive may include an ester, including esters of a dibasic acid (e.g., phthalic, succinic, alkylsuccinic, alkenylsuccinic, maleic, azelaic, suberic, sebacic, fumaric or adipic acid (adipate), or linolic acid dimmer) and alcohol (e.g., butyl, hexyl, 2-ethylhexyl, dodecyl alcohol, ethylene glycol, diethylene glycol monoether or propylene glycol); and esters of a monocarboxylic acid of 5 to 18 carbon atoms and polyol (e.g., neopentyl glycol, trimethylolpropane (TMP), pentacrythritol, dipentaerythritol or tripentaerythritol); a naphthalene compound (e.g., an alkylated naphthalene); and any combination thereof. Other compounds useful as a solubilizing agent include polyoxyalkylene glycol, polyoxyalkylene glycol ester, polyoxyalkylene glycol ether and phosphate ester. In particular embodiments, the solubilizing agent is a TMP ester, an adipate ester, an alkylated naphthalene, and any combination thereof. The solubilizing agent may be incorporated at 2.5 wt. % to 20 wt. % (or 2.5 wt. % to 3 wt. %, or 3 wt. % to 5 wt. %, or 5 wt. % to 10 wt. %, or 15 wt. % to 20 wt. %, or 20 wt. % to 25 wt. %), encompassing any value and subset therebetween, by total weight of the gear oil formulation.

Additives

The gear oil formulations of the present disclosure may comprise one or more additives including, but not limited to, an ashless dispersant, a pour point depressant, an antifoaming agent, an antioxidant, a rust inhibitor, a friction modifier, a viscosity index improver, and the like, and any combination thereof to satisfy diversified characteristics (e.g., those related to friction, oxidation stability, cleanness, defoaming, viscosity, and the like).

The ashless dispersants for use in the gear oil formulations of the present disclosure may include, but are not limited to, those based on polybutenyl succinic acid imide, polybutenyl succinic acid amide, benzylamine, succinic acid ester, succinic acid ester-amide and a boron derivative thereof, and the like, and any combination thereof. When included, the ashless dispersants may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), encompassing any value and subset therebetween, by total weight of the gear oil formulation.

The pour point depressants for use in the gear oil formulations of the present disclosure may include, but are not limited to, ethylene/vinyl acetate copolymer, condensate of chlorinated paraffin and naphthalene, condensate of chlorinated paraffin and phenol, polymethacrylate, polyalkyl styrene, and the like, and any combination thereof. When included, the pour point depressants may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), encompassing any value and subset therebetween, by total weight of the gear oil formulation. It is to be further noted that the gear oil formulations of the present disclosure may be so formulated such that no pour point depressant(s) is required to maintain the pour point of the gear oil below −20° C. That is, the pour point of the gear oil is maintained below −20° C. or lower in the absence of a pour point depressant.

The antifoaming agents for use in the gear oil formulations of the present invention may include, but are not limited to, dimethyl polysiloxane, polyacrylate and a fluorine derivative thereof, poerfluoropolyether, and the like, and any combination thereof. When included, the antifoaming agents may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), encompassing any value and subset therebetween, by total weight of the gear oil formulation.

The antioxidants for use in the gear oil formulations of the present invention may include, but are not limited to, amine-based antioxidants (e.g., alkylated diphenylamine, phenyl-α-naphthylamine and alkylated phenyl-x-naphtylamine); phenol-based antioxidants (e.g., 2,6-di-t-butyl phenol, 4,4'-methylenebis-(2,6-di-t-butyl phenol) and isooctyl-3-(3,5-di-t-butyl-4-hydroxyphenyl) propionate); sulfur-based antioxidants (e.g., dilauryl-3,3'-thiodipropionate); zinc dithiophosphate, and the like, and any combination thereof. When included, the antioxidants may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), encompassing any value and subset therebetween, by total weight of the gear oil formulation.

The rust inhibitors for use in the gear oil formulations of the present invention may include, but are not limited to, a fatty acid, alkenylsuccinic acid half ester, fatty acid soap, alkylsulfonate, polyhydric alcohol/fatty acid ester, fatty acid amine, oxidized paraffin, and alkylpolyoxyethylene ether, and the like, and any combination. When included, the rust inhibitors may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), encompassing any value and subset therebetween, by total weight of the gear oil formulation.

The friction modifiers for use in the gear oil formulations of the present invention may include, but are not limited to, an organomolybdenum-based compound, fatty acid, higher alcohol, fatty acid ester, oil/fat, amine, polyamide, sulfide ester, phosphoric acid ester, acid phosphoric acid ester, acid phosphorous acid ester, amine salt of phosphoric acid ester, and the like, and any combination thereof. When included, the friction modifiers may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), encompassing any value and subset therebetween, by total weight of the gear oil formulation.

The viscosity index improvers for use in the gear oil formulations of the present disclosure may include, but are not limited to, polyisobuylene, polymethacrylate, olefin copolymers (e.g., ethylene-propylene copolymers, ethylene-propylene diene-modified copolymers (EPDMs), and the like), hydrogenated styrenic block copolymers (e.g., styrene-ethylene/butylene-styrene copolymer (SEBS), and the like), and the like, and any combination thereof. When included, the viscosity index improvers may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), encompassing any value and subset therebetween, by total weight of the gear oil formulation. It is to be further noted that the gear oil formulations of the present disclosure may be so formulated such that no viscosity index improver is required to maintain the viscosity index of the gear oil in the range described below (greater than or equal to 150). That is, the viscosity index of the gear oil is maintained at greater than or equal to 150 in the absence of a viscosity index improver.

Gear Oil Formation

The gear oil formulations of the present disclosure comprise at least a Group II bright stock, a PAO basestock, an optional Group II-IV trim oil basestock, and optional Group V co-basestock. Further, the gear oil formulations may comprise a solubilizing agent and one or more additives.

The gear oil formulations may have a kinematic viscosity (ASTM D445-21, 40° C.) of from 300 $mm^2/s$ to 600 $mm^2/s$ (or 320 $mm^2/s$ to 520 $mm^2/s$, or 380 $mm^2/s$ to 520 $mm^2/s$, or 450 $mm^2/s$ to 520 $mm^2/s$), encompassing any value and subset therebetween.

The gear oil formulations may have a kinematic viscosity (ASTM D445-21, 100° C.) of from 20 $mm^2/s$ to 70 $mm^2/s$ (or 20 $mm^2/s$ to 36 $mm^2/s$, or 27 $mm^2/s$ to 36 $mm^2/s$, or 36 $mm^2/s$ to 42 $mm^2/s$, or 45 $mm^2/s$ to 50 $mm^2/s$, or 60 $mm^2/s$ to 70 $mm^2/s$), encompassing any value and subset therebetween.

The gear oil formulations may have an acid number at pH 11.0 (ASTM D2893) of from 0.2 mgKOH/g to 1.0 mgKOH/g (or 0.5 mgKOH/g to 1.0 mgKOH/g, or 0.5 mgKOH/g to 0.6 mgKOH/g, or 0.6 mgKOH/g to 0.7 mgKOH/g, or 0.7 mgKOH/g to 0.8 mgKOH/g, or 0.8 mgKOH/g to 0.9 mgKOH/g, or 0.9 mgKOH/g to 1.0 mgKOH/g), encompassing any value and subset therebetween.

The gear oil formulations may have an oxidation D91 precipitation number in the range of less than 0.025 mL, including 0 mL, encompassing any value and subset therebetween.

The gear oil formulations may have a viscosity index (ASTM D2270-16) of from 120 to 180 (or 120 to 130, or 140 to 160, or 160 to 180, or 160 to 170), encompassing any value and subset therebetween.

The gear oil formulations may have a pour point (IP 15 or ASTM D97) of from −50° C. to −20° C. (or −45° C. to −30° C., or −45° C. to −39° C.), encompassing any value and subset therebetween.

The gear oil formulations of the present disclosure accordingly are competitive with fully synthetic gear oil formulations, even without a pour point depressant. Moreover, the gear oil formulations of the present disclosure exhibit advantages in pressure viscosity coefficient and cost. It is further believed, without being bound by theory, that the gear oil formulations further improve elastohydrodynamic lubrication (EHL) film thickness (resulting in a thicker EHL film), thus critically improving gear life and pitting (e.g., micropitting) performance compared to convention gear oil formulations (e.g., conventional PAO-based gear oils).

Each of the various basestock components of the present disclosure are mixed according to one or more methods of the present disclosure, wherein the mixture in some instances may be heated, such as in a reaction vessel. Thereafter, the optional solubilizing agent and optional additives are included and the mixture homogenized to ensure it is well-mixed and evenly dispersed. The mixture is thereafter cooled.

Further, in one or more embodiments, at least the Group II bright stock and the PAO basestock are pre-blended. Moreover, two or more pre-blends may be themselves blended to achieve a lower viscosity index and a lower kinematic viscosity (40° C. and 100° C.) compared to either of the pre-blends alone. It is to be noted, that alternatively, at least the Group II bright stock and the PAO basestock may be pre-blended without blending with additional pre-blends.

To facilitate a better understanding of the embodiments of the present invention, the following examples of preferred or representative embodiments are given. In no way should the following examples be read to limit, or to define, the scope of the invention.

EXAMPLES

Example 1

In this Example, a gear oil formulation comprising traditional synthetic PAO basestock ("Control") was formulated and compared to a gear oil formulation according to a representative embodiment of the present disclosure ("Experiment"). Various compositional characteristics were tested for each of the Control and Experimental samples, and the formulations and results are provided in Table 1 below:

TABLE 1

| | Units | Control | Experimental |
|---|---|---|---|
| Component | | | |
| Solubilizing Agent | wt. % | 15.0 | 15.0 |
| Light Conventional PAO | wt. % | 10.6 | 0 |
| Heavy Conventional PAO | wt. % | 71.1 | 0 |
| Group II Bright Stock | wt. % | 0 | 32.2 |
| Metallocene PAO | wt. % | 0 | 50.0 |
| Additive Package | wt. % | 3.3 | 2.8 |
| Testing Method | | | |
| D2893 D445-5/ASV Kinematic Viscosity, 100° C. | $mm^2/s$ | 48 | 48 |
| D2893 D664 Acid Number to pH 11 | mgKOH/g | 0.66 | 0.64 |
| D2893 Oxidation D91 Precipitation Number | mL | <0.025 | <0.025 |
| D445 Kinematic Viscosity, 40° C. | $mm^2/s$ | 442 | 453 |

TABLE 1-continued

| | Units | Control | Experimental |
|---|---|---|---|
| D445 Kinematic Viscosity, 100° C. | $mm^2/s$ | 47 | 47 |
| Viscosity Index | N/A | 165 | 164 |
| D7346 Pour Point | ° C. | −42 | −39 |

Example 2

This Example provides various suitable formulations for the gear oils of the present disclosure, as listed in Table 2 below, each in wt. %:

TABLE 2

| Component Name | Blend 1 | Blend 2 | Blend 3 | Blend 4 | Blend 5 | Blend 6 | Blend 7 | |
|---|---|---|---|---|---|---|---|---|
| EHC 340 MAX | 32.2 | 42.2 | 45.0 | 45.0 | 47.2 | 20.0 | 40.0 | Grp. II BS |
| mPAO 300 | 0 | 0 | 0 | 30.0 | 0 | 0 | 0 | PAO |
| mPAO 150 | 50.0 | 40.0 | 35.0 | 0 | 40.0 | 50.0 | 40.0 | |
| mPAO 65 | 0 | 0 | 0 | 0 | 0 | 0 | 0 | |
| PAO 6 | 0 | 0 | 0 | 0 | 0 | 0 | 0 | LS Trim |
| PAO 4 | 0 | 10.0 | 7.2 | 12.2 | 0 | 0 | 0 | Oil |
| EHC 50 | 0 | 0 | 0 | 0 | 5.0 | 0 | 0 | Basestock |
| GTL 4 | 0 | 0 | 0 | 0 | 0 | 20.0 | 18.0 | |
| GTL 8 | 0 | 0 | 0 | 0 | 0 | 0 | 0 | |
| TMP Ester | 0 | 0 | 0 | 0 | 0 | 8.5 | 0 | Solubilizing |
| Adipate Ester | 15.0 | 5.0 | 10.0 | 0 | 0 | 0 | 0 | Agent |
| Alkylated Naphthalene | 0 | 0 | 0 | 10.0 | 5.0 | 0 | 0 | |
| Additives | 2.8 | 2.8 | 2.8 | 2.8 | 2.8 | 1.5 | 2.0 | Additives |
| Total | 100.0 | 100.0 | 100.0 | 100.0 | 100.0 | 100.0 | 100.0 | |

| Component Name | Blend 8 | Blend 9 | Blend 10 | Blend 11 | Blend 12 | Blend 13 | |
|---|---|---|---|---|---|---|---|
| EHC 340 MAX | 27.0 | 20.0 | 30.0 | 33.0 | 15.0 | 37.0 | Grp. II BS |
| mPAO 300 | 0 | 0 | 0 | 0 | 0 | 0 | PAO |
| mPAO 150 | 48.0 | 0 | 45.0 | 45.0 | 45.0 | 37.0 | |
| mPAO 65 | 0 | 65.0 | 0 | 0 | 0 | 0 | |
| PAO 6 | 0 | 0 | 0 | 0 | 0 | 21.5 | LS Trim |
| PAO 4 | 0 | 0 | 5.0 | 0 | 0 | 0 | Oil |
| EHC 50 | 0 | 0 | 0 | 0 | 0 | 0 | Basestock |
| GTL 4 | 18.0 | 0 | 0 | 20.0 | 0 | 0 | |
| GTL 8 | 0 | 3.5 | 0 | 0 | 32.5 | 0 | |
| TMP Ester | 5.0 | 10.0 | 0 | 0 | 0 | 3.0 | Solubilizing |
| Adipate Ester | 0 | 0 | 18.5 | 0 | 6.0 | 0 | Agent |
| Alkylated Naphthalene | 0 | 0 | 0 | 0 | 0 | 0 | |
| Additives | 2.0 | 1.5 | 1.5 | 2.0 | 1.5 | 1.5 | Additives |
| Total | 100.0 | 100.0 | 100.0 | 100.0 | 100.0 | 100.0 | |

Accordingly, the gear oil formulations of the present disclosure provide comparatively or improved formulations compared to more costly, currently used high performance synthetic PAO basestock gear oils.

While various embodiments have been shown and described herein, modifications may be made by one skilled in the art without departing from the scope of the present disclosure. The embodiments described here are exemplary only, and are not intended to be limiting. Many variations, combinations, and modifications of the embodiments disclosed herein are possible and are within the scope of the disclosure. Accordingly, the scope of protection is not limited by the description set out above, but is defined by the claims which follow, that scope including all equivalents of the subject matter of the claims.

EXAMPLE EMBODIMENTS

Embodiments include:

Embodiment A: A gear oil composition comprising: a first oil basestock, the first oil basestock being a Group II bright stock having: a kinematic viscosity (ASTM D445, 40° C.) of from 250 $mm^2/s$ to 600 $mm^2/s$, a kinematic viscosity (ASTM D445, 100° C.) of from 20 $mm^2/s$ to 70 $mm^2/s$, a viscosity index (ASTM D2270) of from 80 to 120, and a pour point (ASTM D97) of from −50° C. to −20° C.; and a second oil basestock, the second oil basestock being a polyalphaolefin (PAO) basestock having: a kinematic viscosity (ASTM D445, 40° C.) of from 500 $mm^2/s$ to 3500 $mm^2/s$, a kinematic viscosity (ASTM D445, 100° C.) of from 60 $mm^2/s$ to 300 $mm^2/s$, a viscosity index (ASTM D2270) of from 150 to 250, and a pour point (ASTM D97) of from −50° C. to −20° C.

Embodiment B: A method comprising: mixing a first oil basestock and a second basestock, wherein the first basestock is a Group II bright stock having: a kinematic viscosity (ASTM D445, 40° C.) of from 250 $mm^2/s$ to 600 $mm^2/s$, a kinematic viscosity (ASTM D445, 100° C.) of from 20 $mm^2/s$ to 70 $mm^2/s$, a viscosity index (ASTM D2270) of from 80 to 120, and a pour point (ASTM D97) of from −50° C. to −20° C.; and wherein the second basestock is a polyalphaolefin (PAO) basestock having: a kinematic viscosity (ASTM D445, 40° C.) of from 500 $mm^2/s$ to 3500 $mm^2/s$, a kinematic viscosity (ASTM D445, 100° C.) of from 60 $mm^2/s$ to 300 $mm^2/s$, a viscosity index (ASTM D2270) of from 150 to 250, and a pour point (ASTM D97) of from −50° C. to −20° C.

Each of Embodiments A and B may have one or more of the following additional elements in any combination:

Element 1: wherein the first oil basestock is present from 15 wt. % to 50 wt. %, by total weight of the gear oil composition.

Element 2: wherein the second oil basestock is present from 10 wt. % to 70 wt. %, by total weight of the gear oil composition.

Element 3: wherein the second oil basestock is selected from the group consisting of a light conventional PAO, a heavy conventional PAO, a metallocene PAO, and any combination thereof.

Element 4: wherein the second oil basestock is a metallocene PAO.

Element 5: wherein the first oil basestock and the second oil basestock is present from 60 wt. % to 99.5 wt. %, by total weight of the gear oil composition.

Element 6: further comprising a solubilizing agent.

Element 7: further comprising a solubilizing agent, wherein the solubilizing agent is selected from the group consisting of a dibasic acid and an alcohol; an ester of a monocarboxylic acid of 5 to 18 carbon atoms and polyol; a polyoxyalkylene glycol; a polyoxyalkylene glycol ester; a polyoxyalkylene glycol ether and phosphate ester; a naphthalene compound; and any combination thereof.

Element 8: further comprising a solubilizing agent, wherein the solubilizing agent is present from 2.5 wt. % to 20 wt. %, by total weight of the gear oil composition.

Element 9: further comprising a third oil basestock, the third oil basestock being a Group V basestock having: a kinematic viscosity (ASTM D445, 40° C.) of from 15 $mm^2/s$ to 600 $mm^2/s$, a kinematic viscosity (ASTM D445, 100° C.) of from 4 $mm^2/s$ to 60 $mm^2/s$, a viscosity index (ASTM D2270) of from 80 to 200, and a pour point (ASTM D97) of from −60° C. to −20° C.

Element 10: further comprising a third oil basestock, wherein the first oil basestock, the second oil basestock, and the third oil basestock is present from 60 wt. % to 99.5 wt. %, by total weight of the gear oil composition.

Element 11: further comprising at least one additive selected from the group consisting of an ashless dispersant, a pour point depressant, an antifoaming agent, an antioxidant, a rust inhibitor, a friction modifier, and any combination thereof.

Element 12: further comprising an ashless dispersant present from 0.05 wt. % to 5 wt. %, by total weight of the gear oil composition.

Element 13: further comprising a pour point depressant present from 0.05 wt. % to 5 wt. %, by total weight of the gear oil composition.

Element 14: further comprising an antifoaming agent present from 0.05 wt. % to 5 wt. %, by total weight of the gear oil composition.

Element 15: further comprising an antioxidant present from 0.05 wt. % to 5 wt. %, by total weight of the gear oil composition.

Element 16: further comprising a rust inhibitor present from 0.05 wt. % to 5 wt. %, by total weight of the gear oil composition.

Element 17: further comprising a friction modifier present from 0.05 wt. % to 5 wt. %, by total weight of the gear oil composition.

Element 18: further comprising a low viscosity Group II-IV trim oil basestock.

Element 19: wherein the gear oil is formulated for lubrication of a gearbox of a wind turbine.

Element 20: wherein the gear oil has a pour point of less than −20° C. in the absence of a pour point depressant.

Element 21: wherein the gear oil has a viscosity index greater than 150 in the absence of a viscosity index improver.

Element 22: wherein the gear oil exhibits a thicker elastohydrodynamic lubrication film thickness compared to conventional PAO-based gear oil compositions.

Element 23: wherein the gear oil is pre-blended and is combined with a second pre-blended gear oil comprising the composition of claim 1, and wherein the combination exhibits a lower viscosity index and lower kinematic viscosity at 40° C. and 100° C. compared to each of the pre-blended compositions alone.

Element 24: wherein the first oil basestock as a kinematic viscosity (ASTM D445, 40° C.) of from 288 $mm^2/s$ to 352 $mm^2/s$.

By way of non-limiting example, exemplary combinations applicable to Embodiments A and B include: any one, more, or all of Elements 1-24, without limitation.

Therefore, the present invention is well adapted to attain the ends and advantages mentioned as well as those that are inherent therein. The particular examples and configurations disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the incarnations of the present inventions. At the very least, and not as an attempt to limit the application of the doctrine of equivalents to the scope of the claim, each numerical parameter should at least be construed in light of the number of reported significant digits and by applying ordinary rounding techniques.

One or more illustrative incarnations incorporating one or more invention elements are presented herein. Not all features of a physical implementation are described or shown in this application for the sake of clarity. It is understood that in the development of a physical embodiment incorporating one or more elements of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

What is claimed is:

1. A gear oil composition comprising:

a first oil basestock, the first oil basestock being a Group II bright stock having:

a kinematic viscosity (ASTM D445, 40° C.) of from 450 $mm^2/s$ to 520 $mm^2/s$, a kinematic viscosity (ASTM D445, 100° C.) of from 20 $mm^2/s$ to 70 $mm^2/s$, a viscosity index (ASTM D2270) of from 80 to 120, and a pour point (ASTM D97) of from −50° C. to −20° C.; and a second oil basestock, the second oil basestock being a polyalphaolefin (PAO) basestock having:

a kinematic viscosity (ASTM D445, 40° C.) of from 500 $mm^2/s$ to 3500 $mm^2/s$, a kinematic viscosity (ASTM D445, 100° C.) of from 60 $mm^2/s$ to 300 $mm^2/s$, a viscosity index (ASTM D2270) of from 150 to 250, and a pour point (ASTM D97) of from −50° C. to −20° C.

2. The gear oil composition of claim 1, wherein the first oil basestock is present from 15 wt. % to 50 wt. %, by total weight of the gear oil composition.

3. The gear oil composition of claim 1, wherein the second oil basestock is present from 10 wt. % to 70 wt. %, by total weight of the gear oil composition.

4. The gear oil composition of claim 1, wherein the second oil basestock is selected from the group consisting of a light conventional PAO, a heavy conventional PAO, a metallocene PAO, and any combination thereof.

5. The gear oil composition of claim 1, wherein the first oil basestock and the second oil basestock combined are present from 60 wt. % to 99.5 wt. %, by total weight of the gear oil composition.

6. The gear oil composition of claim 1, further comprising a solubilizing agent and wherein the solubilizing agent is selected from the group consisting of a dibasic acid and an alcohol; an ester of a monocarboxylic acid of 5 to 18 carbon atoms and polyol; a polyoxyalkylene glycol; a polyoxyalkylene glycol ester; a polyoxyalkylene glycol ether and phosphate ester; a naphthalene compound; and any combination thereof.

7. The gear oil composition of claim 1, further comprising a third oil basestock, the third oil basestock being a Group V basestock having:

a kinematic viscosity (ASTM D445, 40° C.) of from 15 $mm^2/s$ to 600 $mm^2/s$, a kinematic viscosity (ASTM D445, 100° C.) of from 4 $mm^2/s$ to 60 $mm^2/s$, a viscosity index (ASTM D2270) of from 80 to 200, and a pour point (ASTM D97) of from −60° C. to −20° C.

8. The gear oil composition of claim 7, wherein the first oil basestock, the second oil basestock, and the third oil basestock combined are present from 60 wt. % to 99.5 wt. %, by total weight of the gear oil composition.

9. The gear oil composition of claim 1, further comprising at least one additive selected from the group consisting of an ashless dispersant, a pour point depressant, an antifoaming agent, an antioxidant, a rust inhibitor, a friction modifier, and any combination thereof.

10. The gear oil composition of claim 1, further comprising an ashless dispersant present from 0.05 wt. % to 5 wt. %, by total weight of the gear oil composition.

11. The gear oil composition of claim 1, further comprising a pour point depressant present from 0.05 wt. % to 5 wt. %, by total weight of the gear oil composition.

12. The gear oil composition of claim 1, further comprising an antifoaming agent present from 0.05 wt. % to 5 wt. %, by total weight of the gear oil composition.

13. The gear oil composition of claim 1, further comprising (1) an antioxidant present from 0.05 wt. % to 5 wt. %, by total weight of the gear oil composition; (2) a rust inhibitor present from 0.05 wt. % to 5 wt. %, by total weight of the gear oil composition; or both (1) and (2).

14. The gear oil composition of claim 1, further comprising a friction modifier present from 0.05 wt. % to 5 wt. %, by total weight of the gear oil composition.

15. The gear oil composition of claim 1, wherein the gear oil has a pour point of less than −20° C. in the absence of a pour point depressant.

16. The gear oil composition of claim 1, wherein the gear oil has a viscosity index from greater than 150 in the absence of a viscosity index improver.

17. The gear oil composition of claim 1, wherein the gear oil is pre-blended and is combined with a second pre-blended gear oil comprising the composition of claim 1, and wherein the combination exhibits a lower viscosity index and lower kinematic viscosity at 40° C. and 100° C. compared to each of the pre-blended compositions alone.

18. The gear oil composition of claim 1, wherein the first oil basestock has:

a kinematic viscosity (ASTM D445, 100° C.) of from 32.5 $mm^2/s$ to 35.5 $mm^2/s$.

19. A method comprising:

mixing a first oil basestock and a second basestock, wherein the first basestock is a Group II bright stock having:

a kinematic viscosity (ASTM D445, 40° C.) of from 450 $mm^2/s$ to 520 $mm^2/s$, a kinematic viscosity (ASTM D445, 100° C.) of from 20 $mm^2/s$ to 70 $mm^2/s$, a viscosity index (ASTM D2270) of from 80 to 120, and a pour point (ASTM D97) of from −50° C. to −20° C.; and wherein the second basestock is a polyalphaolefin (PAO) basestock having:

a kinematic viscosity (ASTM D445, 40° C.) of from 500 $mm^2/s$ to 3500 $mm^2/s$, a kinematic viscosity (ASTM D445, 100° C.) of from 60 $mm^2/s$ to 300 $mm^2/s$, a viscosity index (ASTM D2270) of from 150 to 250, and a pour point (ASTM D97) of from −50° C. to −20° C.

20. The method of claim 19, further comprising a third oil basestock, the third oil basestock being a Group V basestock having:

a kinematic viscosity (ASTM D445, 40° C.) of from 15 $mm^2/s$ to 600 $mm^2/s$, a kinematic viscosity (ASTM D445, 100° C.) of from 4 $mm^2/s$ to 60 $mm^2/s$, a viscosity index (ASTM D2270) of from 80 to 200, and a pour point (ASTM D97) of from −60° C. to −20° C.

* * * * *